United States Patent [19]

Pope

[11] 4,335,572

[45] Jun. 22, 1982

[54] PROCESS FOR PRODUCTION OF TEXTURED YARN USEFUL IN THE FORMATION OF A CREPE FABRIC

[75] Inventor: John B. Pope, Charlotte, N.C.

[73] Assignee: Fiber Industries, Inc., Charlotte, N.C.

[21] Appl. No.: 258,203

[22] Filed: Apr. 27, 1981

Related U.S. Application Data

[63] Continuation of Ser. No. 139,146, Apr. 10, 1980, abandoned.

[51] Int. Cl.[3] ..... D02G 1/02

[52] U.S. Cl. ..... 57/283; 57/205; 57/208; 57/288

[58] Field of Search ..... 57/205, 208, 247, 283, 57/284, 287, 288, 339

[56] References Cited

U.S. PATENT DOCUMENTS

| | | | |
|---|---|---|---|
| 3,228,181 | 1/1966 | Paterson | 57/283 X |
| 3,651,633 | 3/1972 | Steinmiller | 57/287 X |
| 3,695,026 | 10/1972 | Taylor | 57/288 X |
| 3,710,565 | 1/1973 | Schnegg et al. | 57/205 |
| 3,932,986 | 1/1976 | Kosaka et al. | 57/283 |
| 3,938,227 | 2/1976 | Kawasaki et al. | 57/208 X |
| 3,939,632 | 2/1976 | Doschico et al. | 57/283 |
| 3,977,173 | 8/1976 | Kosaka et al. | 57/208 X |
| 3,978,647 | 9/1976 | Kosaka et al. | 57/283 X |
| 4,012,896 | 3/1977 | Fischbach | 57/339 |
| 4,033,103 | 7/1977 | Vukoje | 57/283 |
| 4,033,105 | 7/1977 | McNeight et al. | 57/339 |
| 4,081,948 | 4/1978 | Parker | 57/288 |
| 4,103,481 | 8/1978 | Vukoje | 57/205 |

FOREIGN PATENT DOCUMENTS 2026559 2/1980 United Kingdom .

*Primary Examiner*—John Petrakes
*Attorney, Agent, or Firm*—Herbert M. Adrian, Jr.

[57] ABSTRACT

A multifilamentary polymeric yarn capable of undergoing false twist texturing is passed through a friction disc aggregate under conditions (as defined) which produce periodic slippage with respect to the friction disc aggregate whereby recurring relatively tightly twisted areas measuring approximately 0.125 to 1.25 inch are substantially maintained along the length of the yarn intermediate recurring textured areas measuring approximately 0.125 to 1.25 inch which include a twist in the opposite direction. The feed yarn may be either partially oriented yarn or a drawn yarn. In a preferred embodiment the feed yarn is a partially oriented polyethylene terephthalate multifilamentary yarn. Unmodified texturing machinery can be employed. The resulting yarn is space textured and may be utilized to form a crepe fabric having highly desirable aesthetic characteristics.

23 Claims, 6 Drawing Figures

Fig. 1
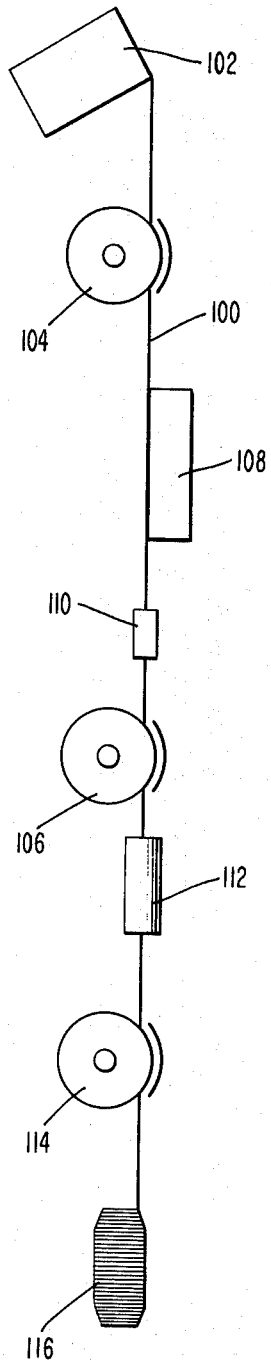
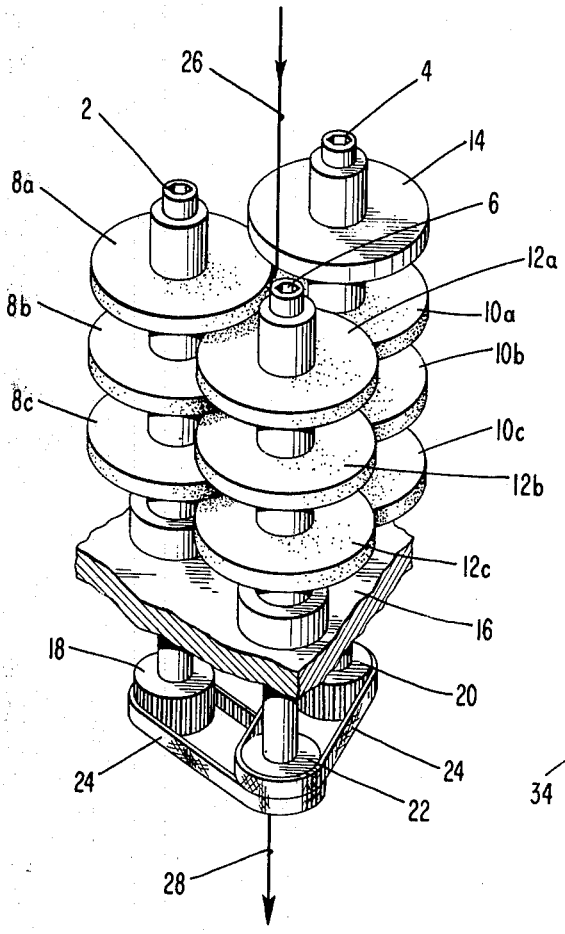
Fig. 2
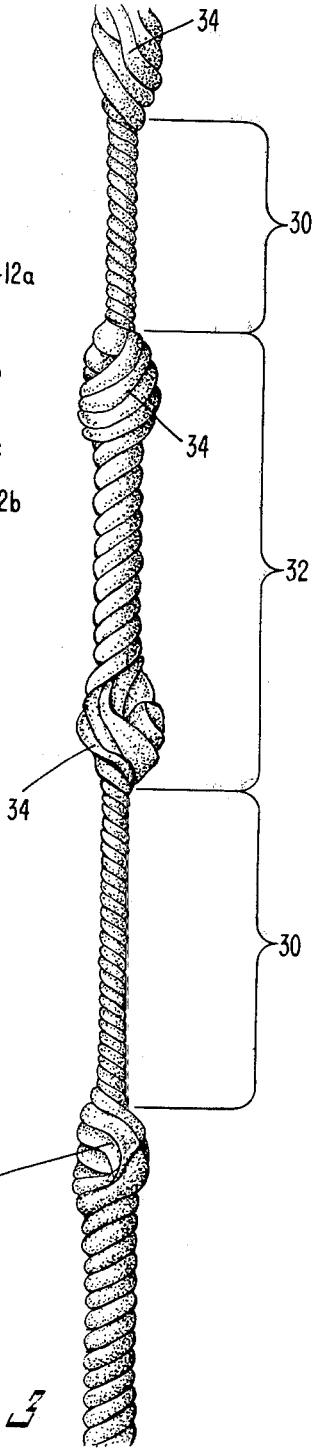
Fig. 3

PROCESS FOR PRODUCTION OF TEXTURED YARN USEFUL IN THE FORMATION OF A CREPE FABRIC

This is a continuation of application Ser. No. 139,146, filed Apr. 10, 1980, now abandoned.

BACKGROUND OF THE INVENTION

Fully textured multifilamentary polymeric yarns long have been known and are an important article of commerce. However, there additionally has been presented a demand in the marketplace for multifilamentary polymeric yarns which exhibit a variation in bulking along their lengths and which are capable of forming fabrics having different hand characteristics, e.g., a crepe fabric. Representative disclosures of such multifilamentary yarns and processes for their production are disclosed in U.S. Pat. Nos. 3,228,181; 3,621,633; 3,695,026; 3,710,565; 3,932,986; 3,938,227; 3,939,632; 3,977,173; 3,978,647; 4,033,103; 4,051,660; 4,064,686; 4,070,815; 4,084,622; and 4,103,481; and British Pat. Nos. 1,240,240 and 1,431,568.

It is an object of the present invention to provide an improved process for the production of a crepe effect multifilamentary yarn.

It is an object of the present invention to provide an improved process for the production of a crepe effect multifilamentary yarn which can be carried out on unmodified false twist texturing machinery on a highly economical basis.

It is another object of the present invention to provide a process for the production of a crepe effect multifilamentary yarn which is capable of being used to form a crepe fabric having highly desirable aesthetic characteristics.

These and other objects, as well as the scope, nature, and utilization of the claimed process will be apparent to those skilled in the art from the following detailed description and appended claims.

BRIEF DESCRIPTION OF THE DRAWINGS

FIG. 1 is a schematic illustration of an apparatus arrangement capable of carrying out the process of the present invention.

FIG. 2 is an illustration of a standard yarn texturing friction disc aggregate which is suitable for use in carrying out the process of the present invention.

FIG. 3 is a schematic illustration of a representative space textured multifilamentary yarn product formed by the process of the present invention showing recurring relatively tightly twisted areas along the length of the yarn intermediate bulked areas which include a twist in the opposite direction.

SUMMARY OF THE INVENTION

Figure 4:
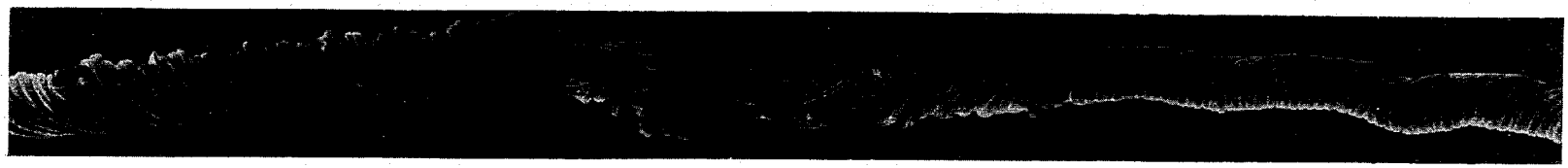
FIG. 4 is a photograph made with a scanning electron microscope at a magnification of approximately 80× of a representative space textured multifilamentary polyethylene terephthalate yarn product formed by the process of the present invention showing a relatively tightly twisted area at the upper portion of the photograph and a textured area at the lower portion of the photograph which includes a twist in the opposite direction.

It has been found that a texturing process for the production of a space textured yarn useful in the formation of a crepe fabric comprises:

(a) continuously passing a multifilamentary polymeric yarn capable of undergoing false twist texturing to a yarn texturing friction disc aggregate having an entrance end and an exit end, (b) continuously passing the multifilamentary polymeric yarn in contact with the yarn texturing friction disc aggregate which rotates at a disc surface speed to yarn speed of approximately 2.2:1 to 3.1:1 whereby a relatively tight twist which averages approximately 40 to 120 turns per inch is imparted to the multifilamentary polymeric yarn immediately prior to reaching the entrance end of the friction disc aggregate, (c) continuously passing the multifilamentary polymeric yarn from the exit end of the friction disc aggregate to a roll which is rotated at a speed sufficient to satisfy the disc surface speed to yarn speed ratio of step (b) and with said yarn under a tension which facilitates periodic slippage of the multifilamentary polymeric yarn with respect to the friction disc aggregate in step (b) whereby recurring relatively tightly twisted areas measuring approximately 0.125 to 1.25 inch are substantially maintained along the length of the yarn intermediate recurring textured areas measuring approximately 0.125 to 1.25 inch which include a twist in the opposite direction which are created at the exit end of the friction disc aggregate, (d) heating the multifilamentary polymeric yarn in a relaxing zone while under a lesser longitudinal tension than employed in steps (a), (b), and (c) sufficient to maintain the yarn at a constant length or to permit up to approximately a 20 percent longitudinal yarn shrinkage whereby bulking of the recurring textured areas which include a twist in the opposite direction occurs while substantially maintaining the recurring relatively tightly twisted areas, with the relatively tightly twisted areas retaining at least 50 percent of the twist achieved immediately prior to reaching the entrance end of the friction disc aggregate, and (e) collecting the resulting yarn.

When a partially oriented multifilamentary polymeric yarn is selected as the starting material such yarn is first hot drawn in a drawing zone situated immediately prior to the entrance end of the friction disc aggregate while simultaneously undergoing twisting.

DESCRIPTION OF PREFERRED EMBODIMENTS

The feed yarn for the present process is a multifilamentary polymeric yarn capable of undergoing false twist texturing. Such yarn is preferably a standard partially oriented yarn which was subjected to a substantial tension during the filament forming operation. Alternatively, the feed yarn may have previously undergone more conventional drawing following spinning.

The preferred starting material is a partially oriented multifilamentary polyester yarn. For instance, the polyester yarn may be composed principally of polyethylene terephthalate and contain 85 to 100 mole percent polyethylene terephthalate and 0 to 15 mole percent of ester units other than polyethylene terephthalate. In a particularly preferred embodiment the yarn is composed of substantially all polyethylene terephthalate. Such yarn commonly is formed from polyethylene terephthalate having an intrinsic viscosity, i.e., I.V., of approximately 0.6 to 0.95 (e.g., approximately 0.6 to 0.7). The I.V. may be conveniently determined by the equation $$\lim_{c \to o} \frac{\ln \eta r}{c}$$

where $\eta r$ is the "relative viscosity" obtained by dividing the viscosity of a dilute solution of the polymer by the viscosity of the solvent employed (measured at the same temperature) and c is the polymer concentration in the solution expressed in grams/100 ml. Other representative yarns capable of being processed in accordance with the present process include those composed of polybutylene terephthalate, melt-processable polyamides such as poly(hexamethylene adipamide) and poly(caprolactam), polypropylene, etc.

When a partially oriented polyethylene terephthalate multifilamentary yarn serves as the feed yarn, it preferably exhibits a birefringence of approximately 0.02 to 0.10, and most preferably approximately 0.02 to 0.05.

The feed yarn for use in the present process commonly has a total denier of approximately 50 to 500 and a denier per filament of approximately 1 to 8 (e.g., approximately 1 to 5). In a particularly preferred embodiment the feed yarn is a partially oriented polyethylene terephthalate multifilamentary yarn having a total denier of approximately 100 to 150 and consists of approximately 30 to 35 filaments.

It has been found that the process of the present invention can be carried out using unmodified false twist texturing machinery to form the desired product. Such machinery by necessity includes a yarn texturing friction disc aggregate. Such friction disc aggregate may be formed in accordance with the teachings of U.S. Pat. Nos. 4,012,896 and 4,068,460 which are herein incorporated by reference. Representative commercially available aggregates suitable for use in the present process include Model No. FTS 45 equipped with Mark I friction discs available from Kugelfischer, and Model No. FK4-32-35Z available from Barmag.

As illustrated in FIG. 2, a typical friction disc aggregate includes three parallel aligned shafts 2, 4 and 6, each shaft carrying three friction discs identified as 8*a*, 8*b*, and 8*c* for shaft 2; 10*a*, 10*b*, and 10*c* for shaft 4; and 12*a*, 12*b*, and 12*c* for shaft 6. Each of the friction discs commonly is coated with a ceramic or refractory coating. However, other coatings which will similarly engage the yarn may be employed. Shaft 4 additionally is provided with an optional polished smooth aluminum disc 14 which serves to aid in the alignment of the yarn to facilitate contact with rotating discs. Shaft members 2, 4, and 6 are supported in broken away housing 16, each said shaft members 2, 4, and 6 having pully means 18, 20, and 22 respectively secured thereto. Belt members 24 pass around a driving pully 22, belt members 24 contacting pully member 18 and 20 thereby causing shaft members 2, 4, and 6 to rotate. Other similar driving mechanisms can be employed as will be apparent to those skilled in the art. Yarn 26 enters the entrance end of the friction disc aggregate and passes around aluminum disc 14 and then between the intermeshing discs of shaft members 2, 4, and 6. This passage causes the yarn to rotate about its axis in the direction opposite to that of the rotation of the discs. Such uptwisting of the yarn occurs prior to the yarn reaching the entrance end of the friction disc aggregate. As can be seen two discs commonly form a guide for the yarn being processed while a third disc forces the yarn into engagement with said two discs. While more than three discs and more than three longitudinally spaced coaxial disc portions may be employed in intermeshing disc friction false twist devices, the preferred number of friction discs for use in conjunction with this invention is nine mounted on three longitudinally spaced shaft members. The yarn leaves the exit end of the friction disc aggregate at 28.

During the operation of the process of the present invention a combination of process parameters are selected (as described hereafter) so as to form a space textured yarn similar to that schematically illustrated in FIG. 3. More specifically, the yarn retains recurring relatively tightly twisted areas measuring approximately 0.125 to 1.25 inch along its length intermediate recurring textured or bulked areas measuring approximately 0.125 to 1.25 inch which include a twist in the opposite direction created at the exit end of the friction disc aggregate. Such maintenance of recurring relatively tightly twisted areas is made possible by periodic slippage of the yarn as it passes through the friction disc aggregate as a result of the relationship of the disc surface speed to the yarn surface speed (as described hereafter) and the tension exerted upon the yarn.

As the multifilamentary yarn leaves the exit end of the friction disc aggregate, it is passed to a roll which is rotated at a speed sufficient to achieve a disc surface speed to yarn speed ratio of approximately 2.2:1 to 3.1:1, and preferably 2.6:1 to 2.9:1 (e.g., approximately 2.7:1). Representative surface speeds for the friction disc aggregate are commonly approximately 2200 to 3100 feet per minute which are achieved by rotating friction discs having a diameter of 50 mm. at approximately 5045 to 5630 revolutions per minute. The yarn speed in the above ratio is computed at the exit end of the friction disc aggregate and commonly is approximately 400 to 1400 feet per minute, and preferably approximately 700 to 1200 feet per minute (e.g., approximately 1000 feet per minute).

During the operation of the process of the present invention the multifilamentary yarn is uptwisted prior to reaching the entrance end of the friction disc aggregate and commonly achieves a twist immediately prior to reaching the entrance end of the friction disc aggregate of approximately 40 to 120 turns per inch. As will be apparent to those skilled in the art, and as reported in the *Journal of the Textile Institute*, No. 3, page 3 (1975), "Improved Method of Friction Twisting in the False Twist Texturing Process, Part II", by M. J. Denton and W. J. Morris, a greater twist level is possible when processing a yarn of relatively low total denier than when a yarn of relatively high total denier is selected. A twist of approximately 50 to 90 turns per inch (e.g., 70 to 85 turns per inch) commonly is achieved immediately prior to reaching the friction disc aggregate when the feed yarn selected has a total denier of approximately 100 to 150. In a particularly preferred embodiment a twist of approximately 80 turns per inch is achieved immediately prior to reaching the friction disc aggregate when processing a feed yarn of approximately 100 to 150 total denier.

Periodic slippage of the yarn occurs as it passes downward through the friction disc aggregate in view of the extremely high ratio of disc surface speed to yarn speed employed and the lower tension exerted upon the yarn than commonly employed in standard false twist texturing processes. An even lesser tension level commonly is exerted upon the yarn below the friction disc aggregate than above the friction disc aggregate because the rotating discs tends to accelerate the moving yarn. Tension levels above the friction disc aggregate commonly range from approximately 0.05 to 0.28 gram per denier, and below the aggregate from approximately 0.02 to 0.07 gram per denier. When such slippage occurs, the previously imparted yarn uptwist is retained by the yarn in recurring relatively tightly twisted areas along the length of the yarn. However, as the friction discs periodically engage the yarn textured areas are created which fall intermediate said relatively tightly twisted areas. Such textured areas are twisted in the opposite direction to the twist previously imparted and are created at the exit end of the friction disc aggregate.

Following passage from the roll situated below the friction disc aggregate the yarn is passed through a heated relaxing zone while under a lesser longitudinal tension than previously utilized in the process whereby bulking of the textured areas occurs and the yarn is additionally heat set. The yarn is passed through the relaxing zone while under a longitudinal tension sufficient to maintain the yarn at a constant length or to permit up to approximately 20 percent longitudinal shrinkage (e.g., up to approximately 10 percent longitudinal shrinkage). When a polyethylene terephthalate yarn is processed, the relaxing zone preferably is maintained at a temperature of approximately 180° to 235° C., and most preferably at a temperature of approximately 215° to 225° C. (e.g., 225° C.).

The resulting yarn is then collected and is schematically illustrated in FIG. 3 wherein the relatively tightly twisted areas 30 measuring approximately 0.125 to 1.25 inch are situated intermediate textured areas 32 likewise measuring approximately 0.125 to 1.25 inch. More highly bulked portions 34 are situated at each end of textured areas 32. Such highly bulked portions 34 represent the transition interface with the relatively tightly twisted areas 30 and possess a considerably lesser twist level than the central portion of textured areas 32. The textured areas 32 include a twist in a direction opposite to that of the relatively tightly twisted zones 30 and are more loosely arranged. For instance, if the tightly twisted areas possess an "S" twist, the textured areas possess a "Z" twist. However, it is possible for the tightly twisted areas to possess a "Z" twist and for the textured areas to possess an "S" twist depending upon the direction of rotation of the friction disc aggregate. In the final product the relatively tightly twisted areas retain at least 50 percent of the twist achieved immediately prior to reaching the entrance end of the friction disc aggregate. In a particularly preferred embodiment wherein the feed yarn is polyethylene terephthalate having a total denier of approximately 100 to 150 consisting of approximately 30 to 35 filaments the relatively tightly twisted areas of the yarn product possess an average twist of at least 50 turns per inch and preferably an average twist of at least 60 turns per inch (e.g., approximately 70 to 85 turns per inch), and the textured areas a lesser twist of no more than approximately 60 turns per inch at the central portion thereof.

When the multifilamentary polymeric feed yarn is supplied in a partially oriented form (e.g., a partially oriented polyester), a drawing zone is situated immediately prior to the yarn texturing friction disc aggregate as is common in the false twist texturing art. Such draw zone may conveniently take the form of a heated draw surface over which the yarn passes while in sliding engagement and while free to receive the uptwisting imparted by the friction disc aggregate. When the feed yarn is a partially oriented polyester the drawing zone commonly is provided at a temperature of approximately 190° to 240° C., and preferably at a temperature of 215° to 235° C., and most preferably at a temperature of 220° to 230° C. (e.g., at approximately 230° C.). The polyester yarn is drawn while present in the drawing zone at a draw ratio of approximately 1.2:1 to 1.5:1, and preferably at a draw ratio of 1.3:1 to 1.4:1.

The yarn product of the present process may be utilized to form a crepe fabric having highly desirable hand characteristics. For instance, the yarn may be knitted to form a circular or warp knit crepe fabric, or woven to form a woven crepe fabric. A preferred fabric is a circular knit of interlock construction having a greige weight of 3.5 oz./sq.yd. Such fabric may be finished by pressure jet dyeing and heat set at 370° F. at a 15 percent overfeed.

The following example is given as a specific illustration of the process. It should be understood, however, that the invention is not limited to the specific details set forth in the example. Reference is made in the drawing to the apparatus arrangement illustrated in FIG. 1.

EXAMPLE

The feed yarn 100 was commercially available from Fiber Industries, Inc. under the designation Type 660, semidull. It possessed a standard Type 8093 lubricant and was composed of 33 partially oriented polyethylene terephthalate filaments having a birefringence of 0.034. The total denier of the yarn was approximately 140. The yarn had been spun from polyethylene terephthalate polymer having an intrinsic viscosity of 0.67. The yarn was provided as supply package 102 and possessed substantially zero twist.

The yarn was pulled off supply package 102 by a positively controlled feeder supply. Positively controlled feed roll with apron 104 was rotated at a surface speed of 752 feet per minute. Draw roll with apron 106 was rotated at a surface speed to 1027 feet per minute and caused the yarn to be drawn at a draw ratio 1.36:1 as it passed in sliding contact with heated draw surface 108. The draw surface consisted of a stainless steel heater surface and was provided at a temperature of 230° C.

Yarn texturing friction disc aggregate 110 was situated intermediate heated draw surface 108 and draw roll with apron 106. The friction disc aggregate 110 was similar to that illustrated in FIG. 2 and was commercially available from Kugelfischer under the designation FTS 45 equipped with Mark I friction discs. The friction disc aggregate 110 consisted of nine ceramic coated friction discs having a diameter of 50 mm. mounted on three longitudinally spaced shaft members. Additionally, the friction disc aggregate 110 included a polished aluminum disc at the entrance end which aided in the direction of yarn onto the friction disc surfaces. The friction disc aggregate was rotated at a rate of approximately 5375 revolutions per minute which created a disc surface speed of approximately 2770 feet per minute and a disc surface speed to yarn speed ratio of approximately 2.7:1. A average twist of approximately 82 turns per inch in the "S" direction was imparted to the yarn immediately prior to reaching the entrance end of the friction disc aggregate. The tension upon the yarn immediately above the friction disc aggregate was approximately 0.12 gram per denier, and the tension upon the yarn immediately below the friction disc aggregate was approximately 0.05 gram per denier. Periodic slippage of the yarn occurred as it passed through the friction disc aggregate. As such slippage occurred the relatively tight "S" twist was maintained in recurring regions. However, as the discs periodically gripped the yarn, textured areas were created at the exit end of the friction disc aggregate which included a looser twist in the "Z" direction. The relatively tight "S" twist areas had an average length of approximately 0.3 inch, and the textured areas which included a twist in the "Z" direction had an average length of approximately 0.7 inch.

The yarn was next passed through relaxing zone 112 maintained at approximately 225° C. while under a lesser longitudinal tension. Following passage through relaxing zone 112 the yarn was wrapped around roll with apron 114 which rotated at a rate of 987 feed per minute. Such overfeed in the bulking zone 112 created an approximately 3.9 percent longitudinal reduction or shrinkage in yarn length and the increased bulking of the textured areas. The relatively tight "S" twist areas were substantially maintained while passed through relaxing zone 112 and exhibited an average twist of approximately 75 turns per inch as the yarn exited from relaxing zone 114. The textured areas exhibited a relatively loose twist having a maximum of approximately 55 turns per inch approximately equidistant from the respective ends of the textured areas. The yarn next was collected in package 116.

Figure 5:
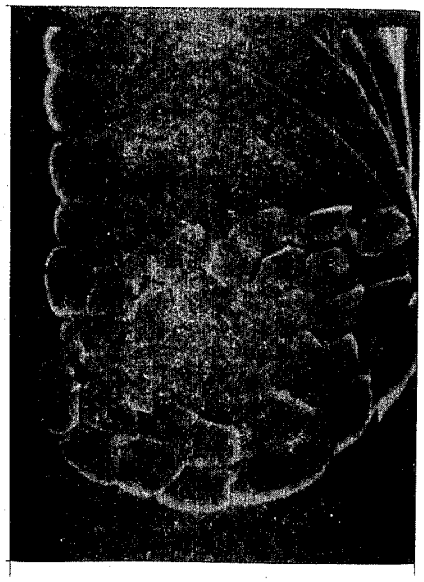
FIG. 5 is a photograph made with the aid of a scanning electron microscope at a magnification of 600× which illustrates a cross-section of a relatively tightly twisted area of the space textured multifilamentary polyethylene terephthalate yarn of FIG. 4.
Figure 6:
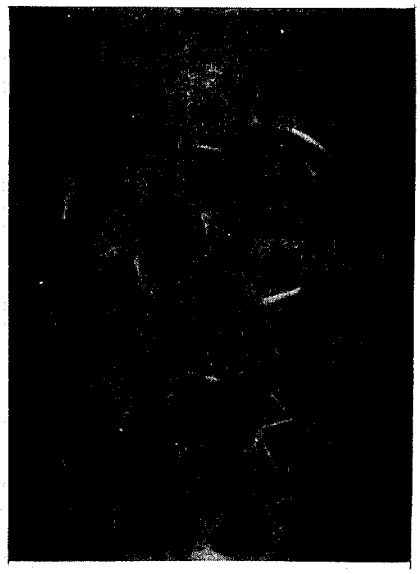
FIG. 6 is a photograph made with the aid of a scanning electron microscope at a magnification of 600× which illustrates a cross-section of a central portion of a textured area of the yarn of FIG. 4.

FIG. 4 is a photograph made with a scanning electron microscope at a magnification of approximately 80× of a representative longitudinal section of the resulting space textured yarn. FIGS. 5 and 6 are photographs of cross-sections of the resulting space textured yarn made with a scanning electron microscope at a magnification of 420×. FIG. 5 illustrates the filament configuration in a representative relatively tight "S" twist area, and FIG. 6 illustrates the filament configuration in a representative central portion of a textured area which is loosely twisted in the "Z" direction.

The resulting yarn exhibited an average denier of 99.4, an average tenacity of 3.25 grams per denier, an average elongation of 41 percent, and a shrinkage of 6.4 percent in a water bath provided at 82° C.

Although the invention has been described with a preferred embodiment, it is to be understood that variations and modifications may be resorted to as will be apparent to those skilled in the art. Such variations and modifications are to be considered within the purview and scope of the claims appended hereto.

I claim:

1. A texturing process for the production of a space textured yarn useful in the formation of a crepe fabric comprising:

(a) continuously passing a multifilamentary polymeric yarn capable of undergoing false twist texturing to a yarn texturing friction disc aggregate having an entrance end and an exit end, (b) continuously passing said multifilamentary polymeric yarn in contact with said yarn texturing friction disc aggregate which rotates at a disc surface speed to yarn speed of approximately 2.2:1 to 3.1:1 whereby a relatively tight twist which averages approximately 40 to 120 turns per inch is imparted to said multifilamentary polymeric yarn immediately prior to reaching said entrance end of said friction disc aggregate, (c) continuously passing said multifilamentary polymeric yarn from said exit end of said friction disc aggregate to a roll which is rotated at a speed sufficient to satisfy said disc surface speed to yarn speed ratio of step (b) and with said yarn under a tension which facilitates periodic slippage of said multifilamentary polymeric yarn with respect to said friction disc aggregate in step (b) whereby recurring relatively tightly twisted areas measuring approximately 0.125 to 1.25 inch are substantially maintained along the length of said yarn intermediate recurring textured areas measuring approximately 0.125 to 1.25 inch which include a twist in the opposite direction which are created at the exit end of said friction disc aggregate, (d) heating said multifilamentary polymeric yarn in a relaxing zone while under a lesser longitudinal tension than employed in steps (a), (b), and (c) sufficient to maintain said yarn at a constant length or to permit up to approximately a 20 percent longitudinal yarn shrinkage whereby bulking of said recurring textured areas which include a twist in said opposite direction occurs while substantially maintaining said recurring relatively tightly twisted areas, with said relatively tightly twisted areas retaining at least 50 percent of said twist achieved immediately prior to reaching said entrance end of said friction disc aggregate, and (e) collecting the resulting yarn.

2. A texturing process according to claim 1 wherein said multifilamentary polymeric feed yarn has a total denier of approximately 50 to 500.

3. A texturing process according to claim 1 wherein said multifilamentary polymeric feed yarn contains 85 to 100 mole percent polyethylene terephthalate and 0 to 15 mole percent of copolymerized ester units other than polyethylene terephthalate.

4. A texturing process according to claim 1 wherein said multifilamentary polymeric feed yarn is polybutylene terephthalate.

5. A texturing process according to claim 1 wherein said multifilamentary polymeric feed yarn is poly(hexamethylene adipamide).

6. A texturing process according to claim 1 wherein said multifilamentary polymeric feed yarn is poly(caprolactam).

7. A texturing process according to claim 1 wherein said multifilamentary polymeric feed yarn is polypropylene.

8. A texturing process according to claim 1 wherein said multifilamentary feed yarn has a total denier of approximately 100 to 150 and an average twist of approximately 50 to 90 turns per inch is imparted to said multifilamentary polymeric yarn immediately prior to reaching said entrance end of said friction disc aggregate.

9. A texturing process according to claim 1 wherein said multifilamentary polymeric yarn is passed from the exit end of said yarn texturing friction disc aggregate at a rate of approximately 400 to 1400 feet per minute.

10. A texturing process according to claim 1 wherein said yarn texturing friction disc aggregate rotates at a disc surface speed to yarn speed of approximately 2.6:1 to 2.9:1 during step (b).

11. A draw texturing process for the production of a space textured yarn useful in the formation of a crepe fabric comprising:

(a) continuously passing a partially oriented multifilamentary polyester yarn having a birefringence of approximately 0.02 to 0.10 through a drawing zone provided at a temperature of approximately 190° to 240° C., (b) continuously passing said multifilamentary polyester yarn following passage through said drawing zone in contact with a yarn texturing friction disc aggregate having an entrance end and an exit end which rotates at a disc surface speed to yarn speed of approximately 2.2:1 to 3.1:1 whereby a relatively tight average twist of 40 to 120 turns per inch is imparted to said multifilamentary polyester yarn immediately prior to reaching said entrance end of said friction disc aggregate, (c) continuously passing said multifilamentary polyester yarn from said exit end of said friction disc aggregate to a draw roll which is rotated at a speed sufficient to satisfy said disc surface speed to yarn speed ratio of step (b) and to cause said multifilamentary polyester yarn to be drawn at a draw ratio of approximately 1.2:1 to 1.5:1 while present in said drawing zone (a) and with said yarn under a tension which facilitates periodic slippage of said multifilamentary polyester yarn with respect to said friction disc aggregate in step (b) whereby recurring relatively tightly twisted areas measuring approximately 0.125 to 1.25 inch are substantially maintained along the length of said yarn intermediate recurring textured areas measuring approximately 0.125 to 1.25 inch which include a twist in the opposite direction which are created at the exit end of said friction disc aggregate, (d) continuously passing said multifilamentary polyester yarn through a relaxing zone provided at a temperature of approximately 180° to 235° C. while under a lesser longitudinal tension than employed in steps (a), (b), and (c) sufficient to maintain said yarn at a constant length or to permit up to approximately a 10 percent longitudinal yarn shrinkage whereby bulking of said recurring textured areas which include a twist in said opposite direction occurs while substantially maintaining said recurring relatively tightly twisted areas, with said relatively tightly twisted areas retaining at least 50 percent of said twist achieved immediately prior to reaching said entrance end of said friction disc aggregate, and (e) collecting the resulting yarn.

12. A draw texturing process according to claim 11 wherein said partially oriented multifilamentary polyester feed yarn contains 85 to 100 mole percent polyethylene terephthalate and 0 to 15 mole percent of ester units other than polyethylene terephthalate.

13. A draw texturing process according to claim 11 wherein said partially oriented multifilamentary polyester feed yarn has a total denier of approximately 50 to 500 and has a denier per filament of approximately 1 to 8.

14. A draw texturing process according to claim 11 wherein drawing zone is provided at a temperature of approximately 215° to 235° C.

15. A draw texturing process according to claim 11 wherein said partially oriented multifilamentary polyester yarn is drawn at a draw ratio approximately 1.3:1 to 1.4:1 while present in said drawing zone.

16. A draw texturing process according to claim 11 wherein said partially oriented multifilamentary polyester feed yarn has a total denier of approximately 100 to 150 and an average twist of approximately 50 to 90 turns per inch is imparted to said partially oriented multifilamentary polyester yarn immediately prior to reaching said entrance end of said friction disc aggregate.

17. A draw texturing process according to claim 11 wherein an average twist of approximately 80 turns per inch is imparted to said partially oriented multifilamentary polyester yarn immediately prior to reaching said entrance end of said friction disc aggregate.

18. A draw texturing process according to claim 11 wherein said multifilamentary polyester yarn is passed from the exit end of said yarn texturing friction disc aggregate at a rate of approximately 700 to 1200 feed per minute.

19. A draw texturing process according to claim 11 wherein said multifilamentary polyester yarn is passed from the exit end of said yarn texturing friction disc aggregate at a rate of approximately 1000 feet per minute.

20. A draw texturing process according to claim 11 wherein said yarn texturing friction disc aggregate rotates at a disc surface speed to yarn speed of approximately 2.6:1 to 2.9:1 during step (b).

21. A draw texturing process according to claim 11 wherein said yarn texturing friction disc aggregate rotates at a disc surface speed to yarn speed of approximately 2.7:1 during step (b).

22. A draw texturing process according to claim 11 wherein said relaxing zone is provided at a temperature of approximately 220° to 230° C.

23. A draw texturing process for the production of a space textured yarn useful in the formation of a crepe fabric comprising:

(a) continuously passing a partially oriented multifilamentary polyethylene terephthalate yarn having a birefringence of approximately 0.02 to 0.05 and a total denier of approximately 100 to 150 consisting of approximately 30 to 35 filaments through a drawing zone provided at a temperature of approximately 220° to 230° C., (b) continuously passing said multifilamentary polyester yarn following passage through said drawing zone in contact with a yarn texturing friction disc aggregate having an entrance end and an exit end which rotates at a disc surface speed to yarn speed of approximately 2.7:1 whereby a relatively tight average twist of approximately 70 to 85 turns per inch is imparted to said multifilamentary polyester yarn immediately prior to reaching said entrance end of said friction disc aggregate, (c) continuously passing said multifilamentary polyethylene terephthalate yarn from said exit end of said friction disc aggregate to a draw roll which is rotated at a rate of approximately 1000 feet per minute to cause said multifilamentary polyethylene terephthalate yarn to be drawn at a draw ratio of approximately 1.3:1 to 1.4:1 while present in said drawing zone (a) and with said yarn under a tension which facilitates periodic slippage of said multifilamentary polyethylene terephthalate yarn with respect to said friction disc aggregate in step (b)

whereby recurring relatively tightly twisted areas measuring approximately 0.125 to 1.25 inch are substantially maintained along the length of said yarn intermediate recurring textured areas measuring approximately 0.125 to 1.25 inch which include a twist in the opposite direction which are created at the exit end of said friction disc aggregate, (d) continuously passing said multifilamentary polyethylene terephthalate yarn through a relaxing zone provided at a temperature of approximately 215° to 225° C. while under a lesser longitudinal tension than employed in steps (a), (b), and (c) sufficient to maintain said yarn at a constant length or to permit up to approximately a 10 percent longitudinal yarn shrinkage whereby bulking of said recurring areas which are twisted in said opposite direction occurs while substantially maintaining said recurring relatively tightly twisted areas having a twist of at least 60 turns per inch, and (e) collecting the resulting yarn.

* * * * *